US010010238B2

(12) United States Patent
Miller et al.

(10) Patent No.: US 10,010,238 B2
(45) Date of Patent: Jul. 3, 2018

(54) FLUID CIRCULATION COMPONENT WITH A LAYERED HEATING ASSEMBLY FOR A WASHING APPLIANCE

(71) Applicant: General Electric Company, Schenectady, NY (US)

(72) Inventors: Gregory Owen Miller, Louisville, KY (US); John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 727 days.

(21) Appl. No.: 14/612,328

(22) Filed: Feb. 3, 2015

(65) Prior Publication Data

US 2016/0220093 A1 Aug. 4, 2016

(51) Int. Cl.
*A47L 15/42* (2006.01)

(52) U.S. Cl.
CPC ..... *A47L 15/4285* (2013.01); *A47L 15/4225* (2013.01)

(58) Field of Classification Search
None
See application file for complete search history.

(56) References Cited

U.S. PATENT DOCUMENTS

| | | | | |
|---|---|---|---|---|
| 8,286,236 | B2 | 10/2012 | Jung et al. | |
| 8,592,519 | B2 | 11/2013 | Martinoni | |
| 2006/0249508 | A1* | 11/2006 | Teufl | H05B 3/44 219/541 |
| 2013/0108252 | A1* | 5/2013 | Liu | F04D 29/426 392/471 |

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A fluid circulation component for a washing appliance may generally include a substrate defining a passageway therethrough for transporting fluid through the substrate. The fluid circulation component may also include a layered heating assembly formed directly onto an inner surface of the substrate. The layered heating assembly may include a heat insulating layer disposed directly on the inner surface, a heat conducting layer disposed radially inwardly from the heat insulating layer so as to form an outer wall of the passageway, first and second electrically insulating layers disposed between the heat insulating and conducting layers and a resistive heating layer positioned between the first and second electrically insulating layers. Additionally, when current is directed through the resistive heating layer, heat may be generated that is transmitted through the layered heating assembly to the heat conducting layer so as to increase a temperature of the fluid being transported through the passageway.

20 Claims, 4 Drawing Sheets

FLUID CIRCULATION COMPONENT WITH A LAYERED HEATING ASSEMBLY FOR A WASHING APPLIANCE

FIELD OF THE INVENTION

The present subject matter relates generally to washing appliances, such as dishwashing appliances and, more particularly, to a layered heating assembly that can be embedded within and/or integrated into a fluid circulation component of a washing appliance.

BACKGROUND OF THE INVENTION

Dishwashing appliances generally include a tub that defines a wash chamber. Rack assemblies can be mounted within the wash chamber for receipt of articles for washing. In addition, spray-arm assemblies within the wash chamber may be used to apply or direct fluid towards the articles disposed within the rack assemblies in order to clean such articles. As is generally understood, dishwashing appliances may often include multiple spray-arm assemblies, such as a lower spray-arm assembly mounted to the tub at a bottom of the wash chamber, a mid-level spray-arm assembly mounted to one of the rack assemblies, and/or an upper spray-arm assembly mounted to the tub at a top of the wash chamber.

Moreover, dishwashing appliances are typically equipped with a fluid circulation system including a plurality of fluid circulation components for directing fluid to the spray-arm assemblies. Specifically, a pump is typically housed within a machine compartment of the dishwasher that is configured to pump fluid along a circulation flow path for subsequent delivery to the spray-arm assemblies. For example, the fluid discharged from the pump may be routed through a diverter assembly and/or one or more fluid conduits disposed along the circulation flow path prior to being delivered to the spray-arm assemblies.

To provide for desired cleaning performance, the fluid directed through the fluid circulation system is often heated. Conventionally, such heating of the fluid has been accomplished by adding separate heating devices along the circulation flow path through which the fluid is passed. Unfortunately, such separate heating devices add significant costs and also occupy valuable space within the dishwashing appliance. To address these issues, manufacturers have attempted to integrate heating rods and film resistors into the components of the fluid circulation system, such as by integrating such heating components into the dishwasher pump. However, the integration of such components typically results in unnecessarily high manufacturing costs and/or requires the use of complex manufacturing processes for sealing the heating component within the fluid circulation component.

Accordingly, an improved heating assembly for a washing appliance that addresses one or more of the issues highlighted above in the prior art would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a fluid circulation component for a washing appliance. The fluid circulation component may generally include a substrate having an outer surface and an inner surface and defining a passageway therethrough for transporting fluid through the substrate. The fluid circulation component may also include a layered heating assembly formed directly onto the inner surface of the substrate. The layered heating assembly may generally include a heat insulating layer disposed directly on the inner surface of the substrate, a heat conducting layer disposed radially inwardly from the heat insulating layer so as to form an outer wall of the passageway, first and second electrically insulating layers disposed between the heat insulating and conducting layers and a resistive heating layer positioned between the first and second electrically insulating layers. Additionally, when current is directed through the resistive heating layer, heat may be generated that is transmitted through the layered heating assembly to the heat conducting layer so as to increase a temperature of the fluid being transported through the passageway.

In another aspect, the present subject matter is directed to a fluid circulation component for a washing appliance. The fluid circulation component may generally include a substrate having an outer surface and an inner surface and defining a passageway therethrough for transporting fluid through the substrate. The fluid circulation component may also include a layered heating assembly formed directly onto the inner surface of the substrate. The layered heating assembly may generally include a first electrically insulating layer disposed directly on the inner surface of the substrate, a second electrically insulating layer disposed radially inwardly from the first electrically insulating layer so as to form an outer wall of the passageway and a resistive heating layer positioned between the first and second electrically insulating layers. Additionally, when current is directed through the resistive heating layer, heat may be generated that is transmitted through the layered heating assembly to the heat conducting layer so as to increase a temperature of the fluid being transported through the passageway.

In a further aspect, the present subject matter is directed to a dishwashing appliance. The dishwashing appliance may generally include a tub defining a wash chamber, at least one spray-arm assembly positioned within the wash chamber and a fluid circulation system configured to deliver fluid to the spray-arm assembly(ies). The fluid circulation system may comprise a fluid circulation component that includes a substrate having an outer surface and an inner surface. The substrate may also define a passageway therethrough for transporting fluid through the fluid circulation component. The dishwashing appliance may also include a layered heating assembly formed directly onto the inner surface of the substrate. The layered heating assembly may generally include a heat insulating layer disposed directly on the inner surface of the substrate, a heat conducting layer disposed radially inwardly from the heat insulating layer so as to form an outer wall of the passageway, first and second electrically insulating layers disposed between the heat insulating and conducting layers and a resistive heating layer positioned between the first and second electrically insulating layers. Additionally, when current is directed through the resistive heating layer, heat may be generated that is transmitted through the layered heating assembly to the heat conducting layer so as to increase a temperature of the fluid being transported through the passageway.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
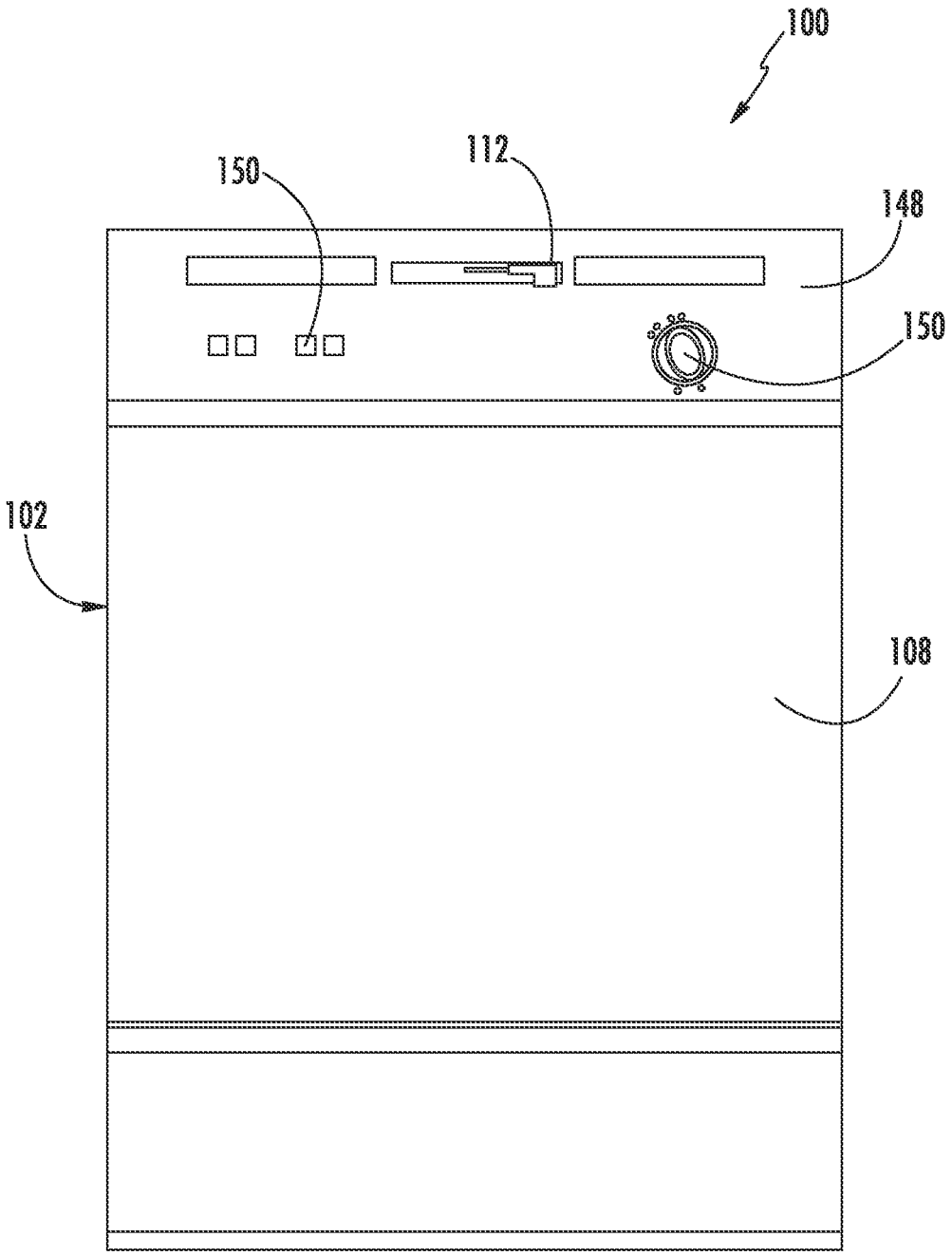
FIG. 1 illustrates a front view of one embodiment of a dishwashing appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a layered heating assembly for use within a fluid circulation component of a washing appliance, such as a dishwashing appliance. Specifically, in several embodiments, the layered heating assembly may include a plurality of different layers configured to be embedded within and/or integrated into the interior of a fluid circulation component for heating the fluid transported therethrough. For example, as will be described below, the layered heating assembly may include a heat insulating layer, a heat conducting layer, one or more electrically insulating layers, a resistive heating layer and/or any other suitable combination of such layers In general, the disclosed layered heating assembly may be manufactured or formed using any suitable process. However, in accordance with several aspects of the present subject matter, the layered heating assembly may be formed using an additive-manufacturing process, such as a 3-D printing process. The use of such a process may allow the layered heating assembly to be formed as an integral surface of any suitable fluid circulation component of a washing appliance. In particular, the manufacturing process may allow the layered heating assembly to be formed integrally with both flat and curved surfaces.

It should be appreciated that the present subject matter will generally be described with reference to the layered heating assembly being utilized within a dishwashing appliance. However, in other embodiments, the layered heating assembly may be utilized within any other suitable washing appliance. For instance, the disclosed layered heating assembly may also be embedded within and/or integrated into the interior of any suitable fluid circulation component(s) used within a washing machine.

Figure 2:
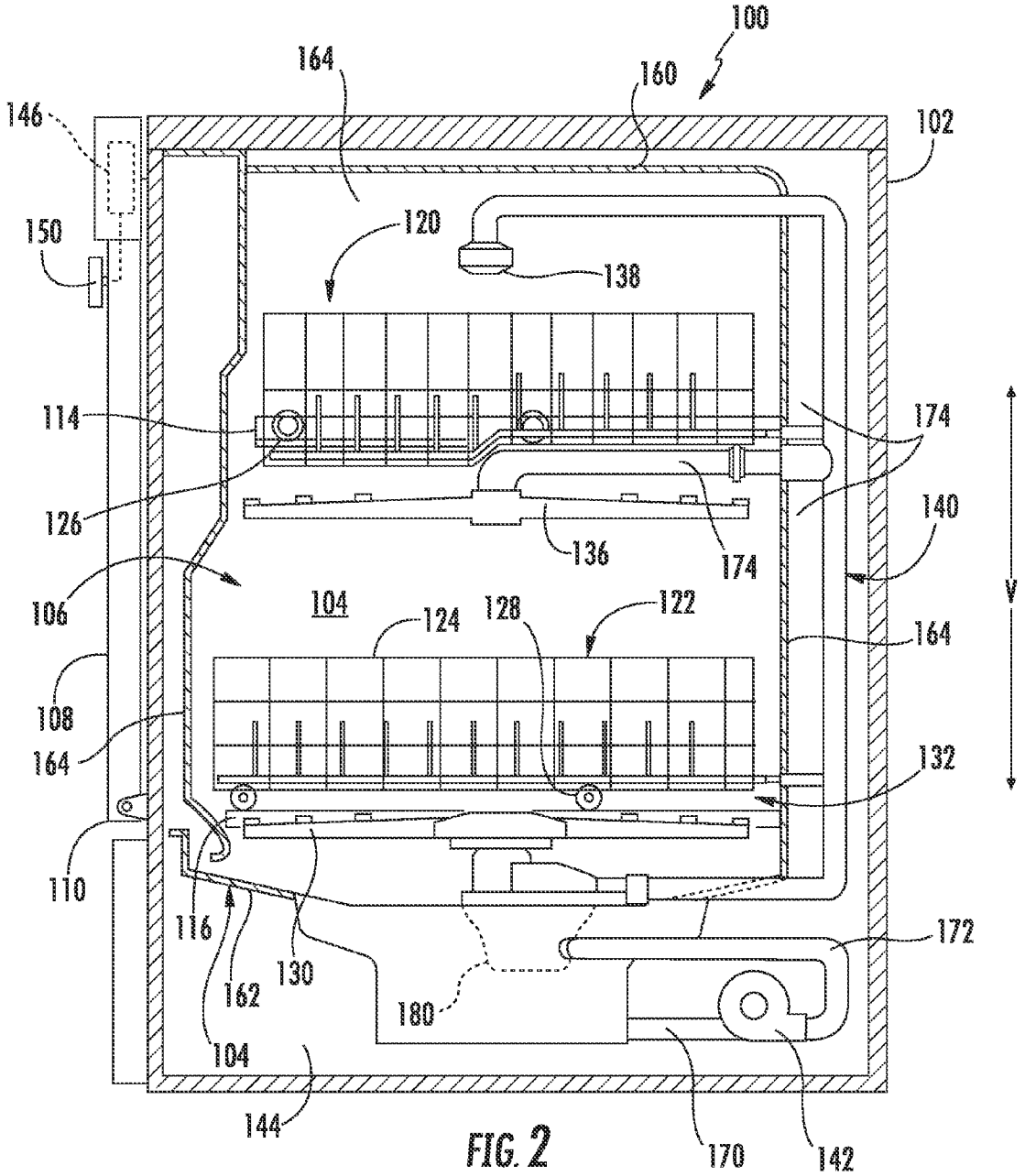
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 112 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 114, 116 may be mounted on opposing side walls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack is substantially positioned outside the wash chamber 106, and a retracted position (shown in FIGS. 1 and 2) in which the rack is located inside the wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by the racks 120, 122.

Additionally, the dishwashing appliance 100 may also include a lower spray-arm assembly 130 that is configured to be rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation system 140 for circulating fluid (e.g., water and dishwasher fluid) within the tub 104. As shown in FIG. 2, the fluid circulation system 140 may also include a pump 142 located in a machinery compartment 144 below the bottom wall 162 of the tub 104, as is generally recognized in the art, and one or more fluid conduits for circulating the fluid delivered from the pump 142 to and/or throughout the wash chamber 106. For example, as shown in FIG. 2, first and second pump conduits 170, 172 may be in fluid communication with the pump 142, with the first pump conduit 170 being configured to deliver fluid to the pump 142 and the second pump conduit 172 being configured to deliver the fluid from the pump 142 to a diverter assembly 180 of the fluid circulation system 140. In addition, one or more fluid conduits may be positioned downstream of the diverter assembly 180 for directing fluid to one or more of the spray arm assemblies 130, 136, 138. For example, as shown in FIG. 2, a fluid conduit 174 may be in fluid communication with the diverter assembly 180 for directing fluid to the mid-level and upper spray arm assemblies 136, 138.

Moreover, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a washing spray.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of the dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. As is generally understood, the user interface 150 may be in communication with the controller 146 via one or more signal lines or shared communication busses.

As indicated above, the fluid recirculation system 140 may also include a diverter assembly 180 in fluid communication with the pump 142. In general, the diverter assembly 180 may be configured to divert fluid between one or more of the spray-arm assemblies 130, 136, 138. For example, in one embodiment, the diverter assembly 180 may include a first outlet (not shown) for directing fluid received from the pump 142 to the lower spray-arm assembly 130 and a second outlet (not shown) for directing the fluid received from the pump 142 to the mid-level and upper spray-arm assemblies 136, 138 (e.g., via the conduit 174). In such an embodiment, the diverter assembly 180 may also include a diverter valve (not shown) for diverting the flow of fluid through the assembly 180 to either its first outlet or its second outlet.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 150, different configurations may be provided for the racks 120, 122, and other differences may be applied as well.

As indicated above, the present subject matter is generally directed to a layered heating assembly for heating fluid transported through a fluid circulation component of a washing appliance. In this regard, FIGS. 3 and 4 illustrate examples of suitable fluid circulation components 200A, 200B within which the layered heating assembly may be embedded or integrated so as to provide improved heating of the fluid transported through such components.

Figure 3:
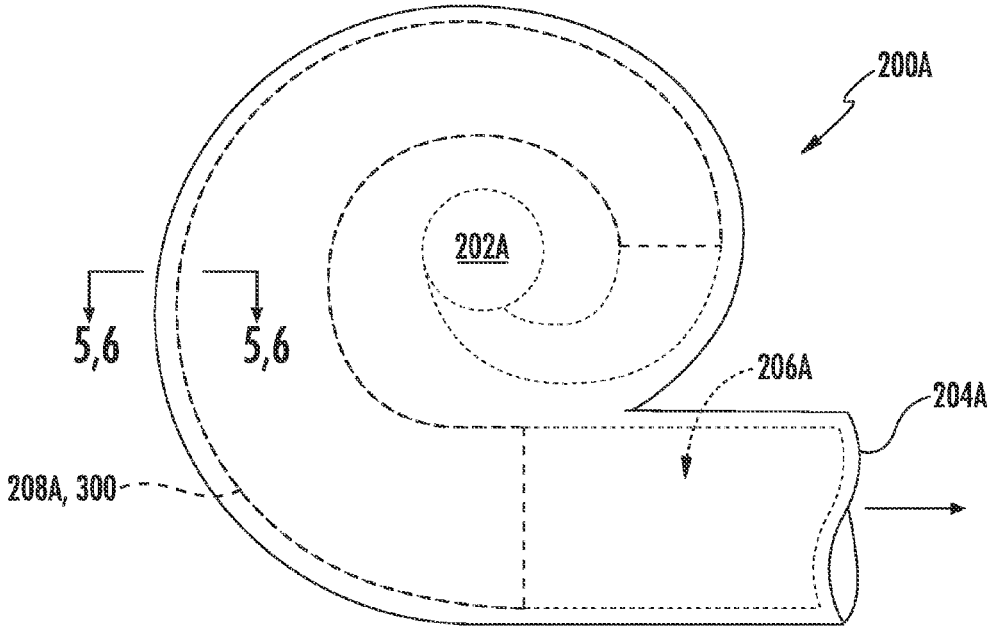
FIG. 3 illustrates a side view of one example of a fluid circulation component within which the disclosed layered heating assembly may be embedded and/or integrated in accordance with aspects of the present subject matter, particularly illustrating a pump suitable for use within the dishwashing appliance shown in FIGS. 1 and 2.
Figure 4:
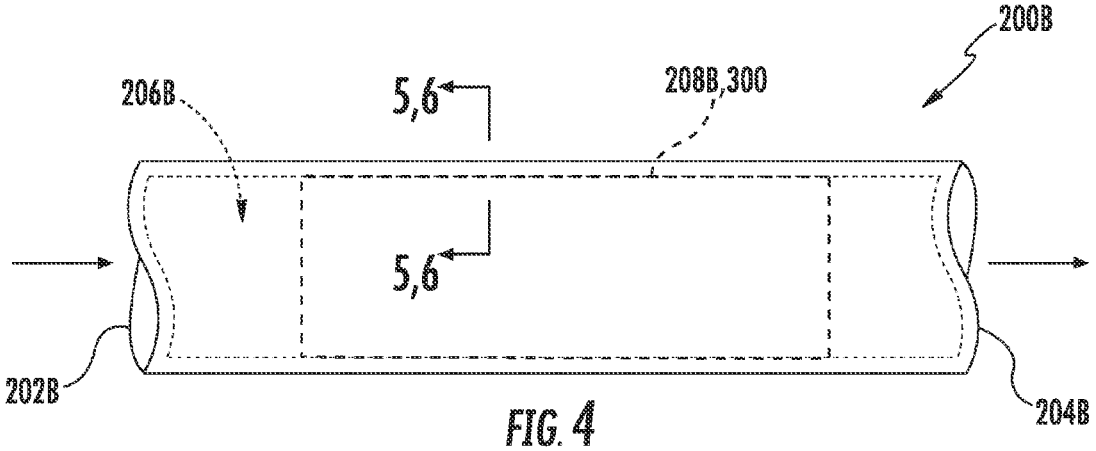
FIG. 4 illustrates a side view of another example of a fluid circulation component within which the disclosed layered heating assembly may be embedded and/or integrated in accordance with aspects of the present subject matter, particularly illustrating a fluid conduit suitable for use within the dishwashing appliance shown in FIGS. 1 and 2.

For example, FIG. 3 illustrates a side view of a pump 200A suitable for use within a washing appliance. The pump 200A may, for instance, correspond to the pump 142 described above with reference to the dishwashing appliance 100 shown in FIGS. 1 and 2. As shown in FIG. 3, the pump 200A may include an inlet 202A (shown in hidden lines), an outlet 204A and a fluid passageway 206A defined between the inlet 202A and the outlet 204A for directing fluid through the pump 200A. In the illustrated embodiment, the pump 200A is configured as a centrifugal pump. As such, the fluid passageway 206A generally defines a spiral-shaped, curved path between the inlet 202A and the outlet 204A. However, in other embodiments, the pump 200A may have any other suitable pump configuration, such as an in-line configuration.

Additionally, as shown in FIG. 3, all or a portion of the passageway 206A defined within the pump 200A may be configured to be heated using the disclosed layered heating assembly. For example, as shown in the illustrated embodiment, the passageway 206A includes a heated section 208A (indicated by the bold dashed lines) within which a layered heating assembly 300 has been embedded or integrated along the interior walls of the passageway 206A. As a result, when fluid is directed through the passageway 206A from the inlet 202A to the outlet 202B, the temperature of the fluid may be increased as heat is transferred from the layered heating assembly 300 to the fluid as it travels through the heated section 208A of the passageway 206A.

As will be described below, due to the configuration of the disclosed layered heating assembly 300, the assembly 300 may be embedded within or integrated into a surface of a fluid circulation component having any suitable geometry, including a flat or straight surface and a curved surface. For example, as shown in FIG. 3, the layered heating assembly 300 may be embedded or integrated along the curved interior surface of the spiraled passageway 206A defined within the pump 200A.

It should be appreciated that, although not shown, the pump 200A may include any other suitable components, including various components typically included within a conventional pump. For example, the pump 200A may include an impeller positioned concentric with the inlet 202A that is configured to be rotationally driven so as to accelerate the flow of fluid through the pump 200A as the fluid is flung radially outwardly due to rotation of the impeller.

As indicated above, a further example of a suitable fluid circulation component 200B within which the layered heating assembly may be embedded or integrated is illustrated in FIG. 4. Specifically, FIG. 4 illustrates a side view of a fluid conduit 200B suitable for use within a washing appliance. The fluid conduit 200B may, for instance, correspond to any of the various fluid conduits (e.g., conduits 170, 172, 174) described above with reference to the dishwashing appliance 100 shown in FIGS. 1 and 2. As shown in FIG. 4, the fluid conduit 200B may include an inlet 202B, an outlet 204B and a fluid passageway 206B defined between the inlet 202B and the outlet 204B for directing fluid through the conduit 200B. Thus, fluid entering the fluid conduit 200B via the inlet 202B may be directed through the passageway 206B and may exit the fluid conduit 200B via the outlet 204B.

Additionally, as shown in FIG. 4, all or a portion of the passageway 206B defined within the fluid conduit 200B may be configured to be heated using the disclosed layered heating assembly. For example, as shown in the illustrated embodiment, the passageway 206B includes a heated section 208B (indicated by the bold dashed lines) within which a layered heating assembly 300 has been embedded or integrated along the interior walls of the passageway 206B. As a result, when fluid is directed through the passageway 206B from the inlet 202B to the outlet 204B, the temperature of the fluid may be increased as heat is transferred from the layered heating assembly 300 to the fluid as it travels through the heated section 208B of the passageway 206B.

Figure 5:
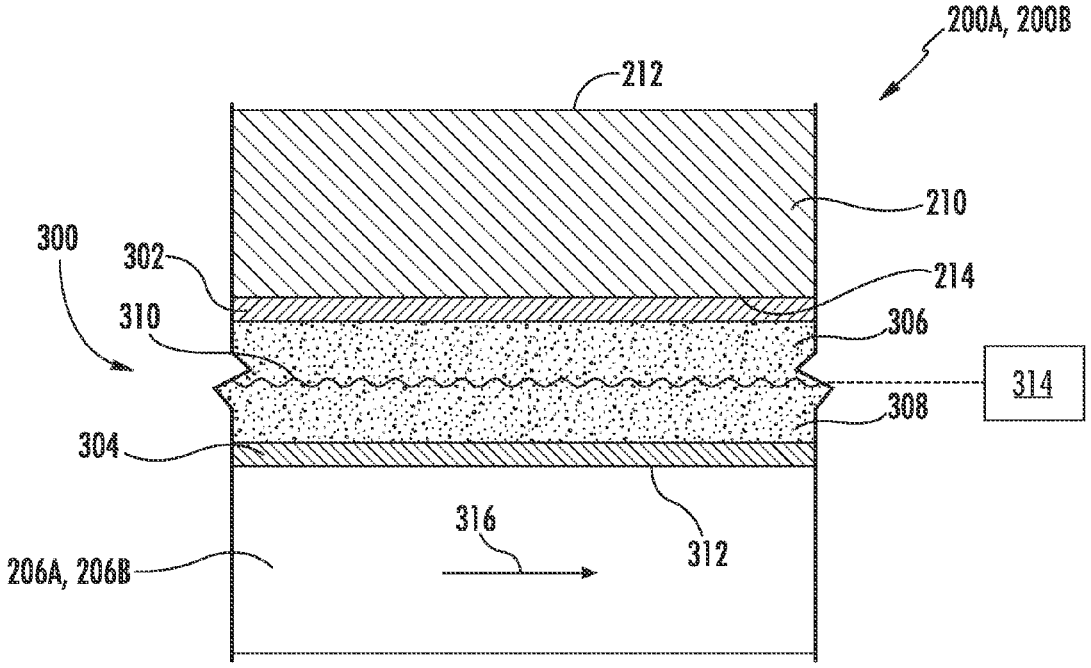
FIG. 5 illustrates a cross-sectional view of the fluid circulation component shown in FIG. 3 and/or FIG. 4 taken about line 5-5 shown in FIGS. 3 and 4, particularly illustrating a cross-sectional view of one embodiment of a layered heating assembly in accordance with aspects of the present subject matter.

Referring now to FIG. 5, a cross-sectional view of one embodiment of a layered heating assembly 300 that may be utilized to heat fluids transported through a fluid circulation component of a washing appliance is illustrated in accordance with aspects of the present subject matter. For instance, the cross-sectional view of the layered heating assembly 300 shown in FIG. 5 may correspond to a partial cross-section of the fluid circulation component 200A, 200B shown in FIG. 3 and/or FIG. 4 (e.g., taken about line 5-5 shown in FIGS. 3 and 4).

In several embodiments, the fluid circulation component 200A, 200B containing the disclosed layered heating assembly 300 may generally include an outer substrate 210 configured to at least partially define a passageway 206A, 206B along which fluid is directed through the fluid circulation component 200A, 200B. As shown in FIG. 5, the substrate 210 may include an outer surface 212 and an inner surface 214 disposed radially inwardly from the outer surface 212. As a result, the inner surface 214 may generally correspond to the surface that would otherwise define the circumferential wall of the passageway 206A, 206B assuming that the layered heating assembly 300 was not formed onto the inner surface 214.

As shown in FIG. 5, the layered heating assembly 300 may generally correspond to an assembly of layers formed directly onto the inner surface 214 of the substrate 210 such that the layered heating assembly 300 extends radially inwardly from the substrate 210. In several embodiments, the layered heating assembly 300 may include a heat insulating layer 302, a heat conducting layer 304, first and second electrically insulating layers 306, 308 and a resistive heating layer 310.

As shown in FIG. 5, the heat insulating layer 302 may correspond to the radially outermost layer of the layered heating assembly 300 and may be configured to be formed directly onto and contact the inner surface 214 of the substrate 210. In general, the heat insulating layer 302 may serve as a heat shield or insulating barrier that is configured to prevent a significant amount of heat transfer from occurring between the layered heating assembly 300 and the substrate 210 forming the associated fluid circulation component 200A, 200B. For instance, the substrate 210 may often be formed from a polymeric material or other material having a relatively low melting temperature. As such, the heat insulating layer 302 may be designed to prevent damage from occurring to the substrate 210 due to overheating (e.g., melting of the substrate).

To provide for such insulation, the heat insulating layer 302 may generally be formed from a material having a relatively low thermal conductivity. For example, suitable materials may include, but are not limited to, stainless steel, titanium and titanium alloys, ceramics and/or the like. Similarly, in one embodiment, suitable materials for the heat insulating layer 302 may have a thermal conductivity value in watts per meter Kelvin (W/(m*K)) of less than about 50 W/(m*K), such as less than about 35 W/(m*K) or less than about 25 W/(m*K) or less than about 10 W/(m*K).

Additionally, as shown in FIG. 5, the heat conducting layer 304 may generally correspond to the radially innermost layer of the layered heating assembly 300 and, thus, may be configured to be form an outer wall 312 of the passageway 206A, 206B through which fluid is directed through the fluid circulation component 200A, 200B. As a result, the heat conducting layer 304 may be configured to directly contact at least a portion of the fluid flowing through the passageway 206A, 206B. In general, the heat conducting layer 304 may serve as a heat transfer layer that is configured to transfer the heat generated by the layered heating assembly 300 to the fluid via conduction.

To provide for such conduction, the heat conducting layer 304 may generally be formed from a material having a relatively high thermal conductivity. For example, suitable materials may include aluminum, copper, silver, tungsten and/or the like. Similarly, in one embodiment, suitable materials for the heat conducting layer 304 may have a thermal conductivity value in watts per meter Kelvin (W/(m*K)) of greater than about 100 W/(m*K), such as greater than about 125 W/(m*K) or greater than about 150 W/(m*K) or greater than about 200 W/(m*K).

Moreover, as shown in FIG. 5, the first and second electrically insulating layers 306, 308 may be disposed between the heat insulating and conducting layers 302, 304 and may be configured to sandwich or surround the resistive heating layer 310. In general, the electrically insulating layers 306, 308 may be configured to electrically isolate the resistive heating layer 310 from its surroundings. As a result, the electrically insulating layers 306, 308 may be configured to prevent current flowing through the resistive heating layer 310 from being conducted to other layers of the layered heating assembly 300 and/or to the substrate 210 of the fluid circulation component 200A, 200B.

In several embodiments, the electrically insulating layers 306, 208 may be formed from a dielectric material that is capable of withstanding the operating temperatures associated with the heat generated by the layered heating assembly 300. For example, dielectric materials suitable for use as the electrically insulating layers 306, 308 include, but are not limited to, magnesium oxide, quartz, aluminum oxide, magnesium oxide, silica, beryllium oxide and/or any other suitable dielectric materials.

As indicated above, the resistive heating layer 310 may be sandwiched between the electrically insulating layers 306, 308 within the layered heating assembly 300. In general, the resistive heating layer 310 may correspond to a layer of any suitable resistive material that generates heat energy when an electrical current is transmitted therethrough. For example, suitable resistive heating materials may include, but are not limited to, certain ceramic materials (e.g., aluminum oxide and chromium oxide), aluminum, copper, carbon, steel alloys and/or the like.

As shown in FIG. 5, to allow for the generation of heat, a power source 314 may be configured to be electrically coupled to the resistive heating layer 310. In general, the power source 314 may correspond to any suitable electrical device and/or component or other source of power that is configured to deliver an electrical current through the resistive heating layer 310, thereby allowing the layered heating assembly 300 to generate heat. For example, the power source 314 may simply correspond to the main power source (not shown) for the washing appliance within which the layered heating assembly 300 is being used (e.g., the power source for the dishwashing appliance 100 shown in FIGS. 1 and 2). Alternatively, the power source 314 may correspond to an electrical circuit or any other component that is electrically coupled between the resisting heating layer 310 and the main power source for the washing appliance.

During use of the layered heating assembly 300, a suitable current may be supplied from the power source 314 through the resistive heating layer 310. Due to its resistive properties, the resistive heating layer 310 may generate heat energy as the current passes therethrough. The heat generated by the resistive heating layer 310 may then be transferred radially through the layered heating assembly 300. In this regard, at least a portion of the heat transferred radially outwardly through the layered heating assembly 300 may be prevented from being transmitted to the substrate 210 of the fluid circulation component 200A, 200B due to the heat insulating layer 302. In contrast, all or a significant portion of the heat transferred radially inwardly through the layered heating assembly 300 may be conducted through the heat conducting layer 304 and transmitted to the fluid flowing through the passageway 206A, 206B (indicated by arrow 316), thereby allowing for the layered heating assembly 300 to increase the temperature of the fluid 316 passing through the fluid circulation component 200A, 200B.

Figure 6:
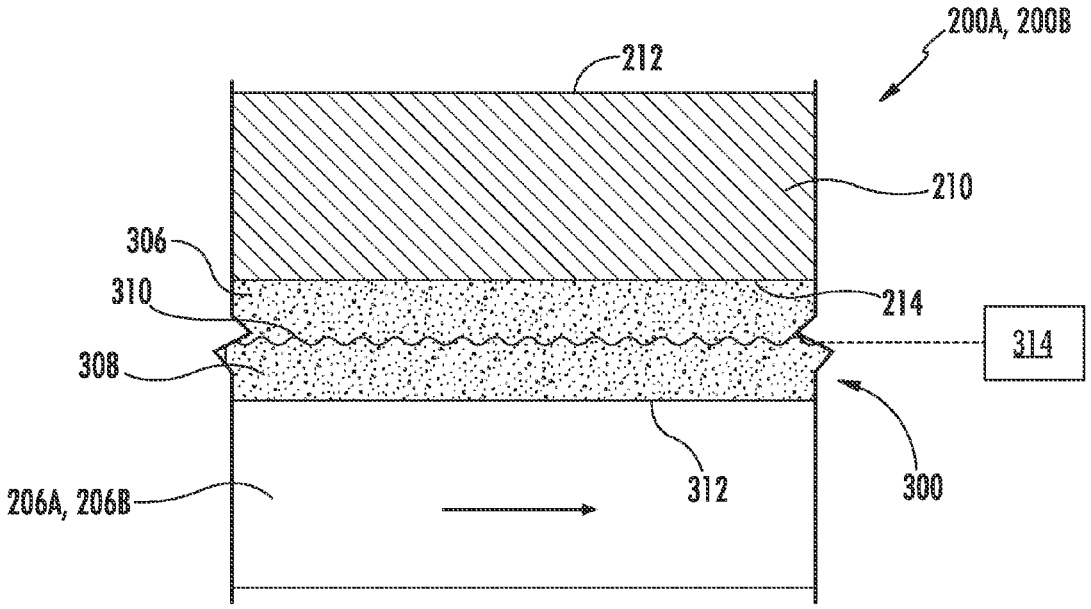
FIG. 6 illustrates another cross-sectional view of the fluid circulation component shown in FIG. 3 and/or FIG. 4 taken about line 6-6 shown in FIGS. 3 and 4, particularly illustrating a cross-sectional view of another embodiment of a layered heating assembly in accordance with aspects of the present subject matter.

Referring now to FIG. 6, a cross-sectional view of another embodiment of a layered heating assembly 300 that may be utilized to heat fluids transported through a fluid circulation component of a washing appliance is illustrated in accordance with aspects of the present subject matter. For instance, the cross-sectional view of the layered heating assembly 300 shown in FIG. 6 may correspond to a partial cross-section of the fluid circulation component 200A, 200B shown in FIG. 3 and/or FIG. 4 (e.g., taken about line 6-6 shown in FIGS. 3 and 4).

As shown in FIG. 6, the layered heating assembly 300 may generally correspond to an assembly of layers formed directly onto the inner surface 214 of the substrate 210 such that the layered heating assembly 300 extends radially inwardly from the substrate 210. However, unlike the embodiment described above with reference to FIG. 5, the layered heating assembly 200 only includes first and second electrically insulating layers 306, 308 and a corresponding resistive heating layer 310. Specifically, as shown in FIG. 6, the first electrically insulating layer 306 may correspond to the radially outermost layer of the layered heating assembly 300 and may be configured to be formed directly onto and contact the inner surface 214 of the substrate 210. Similarly, the second electrically insulating layer 306 may correspond to the radially innermost layer of the layered heating assembly 300 and, thus, may be configured to be form an outer wall 312 of the passageway 206A, 206*b* through which fluid is directed through the fluid circulation component 200A, 200B. Additionally, as shown in FIG. 6, the resistive heating layer 310 may be sandwiched between the first and second electrically insulating layers 306, 308.

It should be appreciated that the electrically insulating layers 306, 308 and the resistive heating layer 310 shown in FIG. 6 may generally be configured the same as or similar to the corresponding layers described above with reference to FIG. 5. For instance, the electrically insulating layers 306, 308 may be configured to electrically isolate the resistive heating layer 310 and may be formed from any suitable material that provides such functionality, such as a dielectric material (e.g., magnesium oxide, quartz, aluminum oxide, magnesium oxide, silica, beryllium oxide and/or any other suitable dielectric materials). Similarly, the resistive heating layer 310 may generally correspond to a layer of any suitable resistive material that generates heat energy when an electrical current is transmitted therethrough (e.g., via a suitable power source 314). In this regard, as indicated above, suitable resistive heating materials may include, but are not limited to, certain ceramic materials (e.g., aluminum oxide and chromium oxide), aluminum, copper, carbon, steel alloys and/or the link.

It should be appreciated that the layered heating assemblies 300 shown in FIGS. 5 and 6 may generally be formed within the passageway defined within a fluid circulation component using any suitable process and/or methodology known in the art. However, as indicated above, in a particular embodiment, the layered heating assemblies 300 may be formed using a 3-D printing process and/or any other suitable additive manufacturing process. For instance, the 3-D printing process may be used to manufacture the entire fluid circulation component, with the layered heating assembly 300 being formed as an integral part thereof.

It should also be appreciated that, although the present subject matter has been generally described with reference to layered heating assemblies 300 being formed within the interior of a fluid circulation component, the layered heating assemblies 300 may generally be formed on any other suitable surface to provide for desired heating. For example, in an alternative embodiment, the disclosed layered heating assemblies 300 may be formed onto the interior of one of the walls of the dishwasher tub 104, such as the top wall 160, the bottom wall 162 and/or one or more of the sidewalls 164 of the tub 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fluid circulation component for a washing appliance, the fluid circulation component comprising:

a substrate having an outer surface and an inner surface, the substrate defining a passageway therethrough for transporting fluid through the substrate;

a layered heating assembly formed directly onto the inner surface of the substrate, the layered heating assembly comprising:

a heat insulating layer disposed directly on the inner surface of the substrate;

a heat conducting layer disposed radially inwardly from the heat insulating layer so as to form an outer wall of the passageway;

first and second electrically insulating layers disposed between the heat insulating and conducting layers; and a resistive heating layer positioned between the first and second electrically insulating avers, wherein, when a current is directed through the resistive heating layer, heat is generated that is transmitted through the layered heating assembly to the heat conducting layer so as to increase a temperature of the fluid being transported through the passageway.

2. The fluid circulation component of claim 1, wherein the heat insulating layer is formed from a material having a low thermal conductivity so as to at least partially insulate the substrate from the heat generated by the resistive heating layer.

3. The fluid circulation component of claim 1, wherein the heat conducting layer is formed from a material having a high thermal conductivity so as to allow at least a portion of the heat generated by the resistive heating layer to pass through the heat conducting layer in order to increase the temperature of the fluid.

4. The fluid circulation component of claim 1, wherein the first and second electrically insulating layers are formed from a dielectric material.

5. The fluid circulation component of claim 4, wherein the dielectric material comprises at least one of magnesium oxide or quartz.

6. The fluid circulation component of claim 1, wherein the resistive heating layer is formed from at least one of a ceramic material, aluminum, copper, carbon or a steel alloy.

7. The fluid circulation component of claim 1, wherein the layered heating assembly is formed directly onto the inner surface of the substrate using an additive-manufacturing process.

8. The fluid circulation component of claim 1, wherein the inner surface of the substrate corresponds to a curved surface, the layered heating assembly being formed directly onto the curved surface.

9. The fluid circulation component of claim 1, wherein the fluid circulation component comprises a pump of the washing appliance.

10. The fluid circulation component of claim 1, wherein the fluid circulation component comprises a fluid conduit of the washing appliance.

11. The fluid circulation component of claim 1, wherein the washing appliance comprises a dishwashing appliance.

12. A fluid circulation component for a washing appliance; the fluid circulation component comprising:

a substrate having an outer surface and an inner surface, the substrate defining a passageway therethrough for transporting fluid through the substrate;

a layered heating assembly formed directly onto the inner surface of the substrate, the layered heating assembly comprising:

a first electrically insulating layer disposed directly on the inner surface of the substrate;

a second electrically insulating layer disposed radially inwardly from the first electrically insulating layer so as to form an outer wall of the passageway; and a resistive heating layer positioned between the first and second electrically insulating layers, wherein, when a current is directed through the resistive heating layer, heat is generated that is transmitted through the layered heating assembly so as to increase a temperature of the fluid being transported through the passageway.

13. The fluid circulation component of claim 12, wherein the first and second electrically insulating layers are formed from a dielectric material.

14. The fluid circulation component of claim 13, wherein the dielectric material comprises at least one of magnesium oxide or quartz.

15. The fluid circulation component of claim 12, wherein the resistive heating layer is formed from at least one of a ceramic material, aluminum, copper, carbon or a steel alloy.

16. The fluid circulation component of claim 12, wherein the layered heating assembly is formed directly onto the inner surface of the substrate using an additive-manufacturing process.

17. The fluid circulation component of claim 12, wherein the inner surface of the substrate correspond to a curved surface, the layered heating assembly being formed directly onto the curved surface.

18. The fluid circulation component of claim 1, wherein the fluid circulation component comprises one of a pump or a fluid conduit of the washing appliance.

19. The fluid circulation component of claim 1, wherein the washing appliance comprises a dishwashing appliance.

20. A dishwashing appliance, comprising:

a tub defining a wash chamber;

at least one spray-arm assembly positioned within the wash chamber;

a fluid circulation system configured to deliver fluid to the at least one spray-arm assembly, the fluid circulation system including a fluid circulation component, the fluid circulation component including a substrate having an outer surface and an inner surface, the substrate defining a passageway therethrough for transporting fluid through the fluid circulation component; and a layered heating assembly formed directly onto the inner surface of the substrate, the layered heating assembly comprising:

a heat insulating layer disposed directly on the inner surface of the substrate;

a heat conducting layer disposed radially inwardly from the heat insulating layer so as to form an outer surface of the passageway;

first and second electrically insulating layers disposed between the heat insulating and conducting layers; and a resistive heating layer positioned between the first and second electrically insulating layers, wherein, when a current is directed through the resistive heating layer, heat is generated that is transmitted through the layered heating assembly to the heat conducting layer so as to increase a temperature of the fluid being transported through the passageway.

* * * * *